United States Patent [19]

Takada

[11] Patent Number: 4,685,492

[45] Date of Patent: Aug. 11, 1987

[54] READING DEVICE IN DOBBY MACHINE

[75] Inventor: Hiroshi Takada, Kyoto, Japan

[73] Assignee: Murata Kikai Kabushiki Kaisha, Kyoto, Japan

[21] Appl. No.: 743,475

[22] Filed: Jun. 10, 1985

[30] Foreign Application Priority Data

Jun. 11, 1984 [JP] Japan ..... 59-119712

[51] Int. Cl.[4] ..... D03C 1/06

[52] U.S. Cl. ..... 139/68; 139/71; 139/331

[58] Field of Search ..... 139/68, 71, 66 R, 331

[56] References Cited

U.S. PATENT DOCUMENTS

| | | | |
|---|---|---|---|
| 3,307,591 | 5/1965 | Staubli . | |
| 3,381,719 | 5/1968 | Favre . | |
| 3,441,060 | 4/1969 | Schwartz . | |
| 3,951,176 | 4/1976 | Koyama . | |
| 4,386,631 | 6/1983 | Mizoguchi . | |
| 4,527,597 | 7/1985 | Yoshida et al. | 139/68 |
| 4,557,298 | 12/1985 | Froment | 139/71 |

FOREIGN PATENT DOCUMENTS

| | | | |
|---|---|---|---|
| 47-32169 | 11/1972 | Japan . | |
| 58-70732 | 4/1983 | Japan | 139/71 |
| 59-179840 | 10/1984 | Japan | 139/71 |
| 370025 | 7/1963 | Switzerland . | |
| 473919 | 7/1969 | Switzerland | 139/71 |
| 853856 | 11/1960 | United Kingdom . | |
| 988690 | 4/1965 | United Kingdom . | |

*Primary Examiner*—James Kee Chi

*Attorney, Agent, or Firm*—Spensley, Horn, Jubas & Lubitz

[57] ABSTRACT

In a reading device for a dobby machine, the reading levers and retaining hooks are pivotally mounted on separate axes. Each reading lever rotates a retaining hook so that the angular velocity of the retaining hook decreases as the retaining hook pivots from its disengaged to engaged position and increases when the retaining hook is disengaged. This acceleration and deceleration cushions the impact that the retaining hook experiences with changes in rotational direction.

17 Claims, 7 Drawing Figures

READING DEVICE IN DOBBY MACHINE

BACKGROUND OF THE INVENTION

The present invention relates to a reading device for a dobby machine.

There is known a reading device in which a reading lever is adapted to rotate and shift between two positions around a single shaft according to whether a peg on a rotating cylinder is present. A retaining hook is pivotably mounted on said shaft and connected to the reeding lever through a spring. The reeding lever and retaining hook are integrally rotatable. The retaining hook is adapted to take engaged and disengaged positions with respect to a periodically pivoting movable hook.

More particularly, an intermediate position of a balk which pivotally supports movable hooks at both ends thereof is rotatably supported by a fore end portion of a balk lever which is pivotable around a fixed shaft independent of the shaft of the reading lever. The movable hooks at both ends of the balk are adapted to move with the pivotal motion of the balk between engaged and disengaged positions with respect to the retaining hook by being pushed with pushing bars which are adapted to reciprocate in opposite directions alternately at a 180° shift.

Therefore, when the movable hook on one side of the balk is pushed by a pushing bar and reaches the position of engagement with the retaining hook while the retaining hook integral with the reading lever displaced in abutment with the peg on the cylinder is located in the engaged position, the retaining hook is slightly moved forcibly by the movable hook against the force of the spring connected to the reading lever, so that the movable hook and the retaining hook come into engagement with each other. Further, as the movable hook portion on the opposite side is pushed by a pushing bar, the balk lever turns around the fixed shaft and a heald frame ascends or descends through a jack lever connected to the said balk lever and a wire rope, whereby a warp shedding is performed.

In the above dobby machine, the reading lever and the retaining hook are supported coaxially rotably and a spring is connected between the reeding lever and the retaining hook so that the reading lever and the retaining hook are integrally rotatable while the reading lever is in pressure contact with a stopper on the retaining hook. Further, the retaining hook is urged away from the movable hook by means of a spring disposed between the retaining hook and another fixed pin. This urging force also serves to urge the reading lever against the peg on the cylinder.

In such reading device, when the reading lever is displaced by the peg on the cylinder, the retaining hook turns at the same angle as the turning angle of the reading lever; that is, the angular velocity of the reading lever and that of the retaining hook are equal. Therefore, the turning speed of the retaining hook from its disengaged to engaged position with respect to the movable hook is constant, so at a high speed, e.g. 500–1000 r.p.m., of the dobby machine, there may occur shock or vibration and out-of-engagement with the movable hook when the retaining hook reaches its position of engagement, or sudden movement and stop may cause a crack of the weaker member at the portion of abutment between the reading lever and the retaining hook.

Further, as to the urging force of the reading lever against the peg, the force of an exclusive-use spring acts directly as such urging force as previously noted, so the extension of the spring with displacement of the reading lever directly increases the load to the peg, thus accelerating wear of the peg surface. Besides, with speed-up of the dobby, the peg strongly abuts and displaces the reading lever, so there may occur breakage due to impact fatigue of the weaker member, thus shortening the service life.

It is the object of the present invention to solve the above-mentioned problems.

SUMMARY OF THE INVENTION

In the present invention, a reading lever adapted to shift between two positions according to whether a peg is present or not is supported on a first fixed shaft. A retaining hook, adapted to be displaced by the reading lever between two positions of engagement and disengagement with respect to a movable hook, is supported on a second fixed shaft. The reading lever having a slider which is in abutment with a slide surface formed on the retaining hook. A spring acting in a direction in which the slider comes into pressure contact with the above slide surface is connected between the reeding lever and the retaining hook. The first and second fixed shafts are disposed in such a positional relation that when the retaining hook turns while the slider slides along the slide surface of the retaining hook as the reading lever turns at a constant speed, the turning speed of the retaining hook gradually decreases when the hook turns toward the position of engagement and gradually increases when it turns toward the position, of disengagement.

DETAILED DESCRIPTION OF THE PREFERRED EMBODIMENTS

Embodiments of the present invention will be described hereinunder with reference to the drawings.

Figure 2:
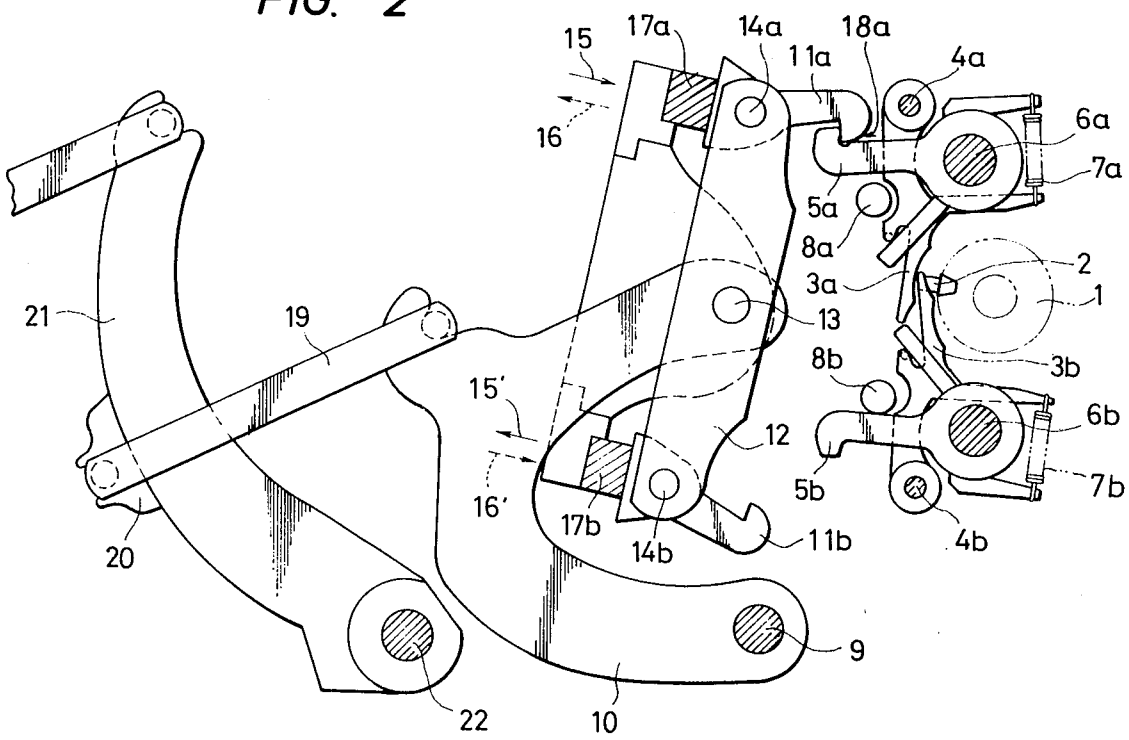
FIG. 2 is a schematic front view of a dobby machine to which is applied the present invention.

Referring to FIG. 2, there is schematically illustrated a construction of a dobby machine, in which reading levers 3*a* and 3*b*, adapted to turn and shift between two positions according to whether a peg 2 on a cylinder 1 is present or not are pivotably mounted on first fixed shafts 4*a* and 4*b*. Retaining hooks 5*a* and 5*b* adapted to turn and shift with displacement of the reading levers 3*a* and 3*b* are pivotably mounted on second fixed shafts 6*a* and 6*b*.

Between the reading lever 3*a* and the retaining hook 5*a* is disposed a tension spring 7*a*. The reading lever 3*a* and the retaining hook 5*a* substantially perform an integral movement on the basis of a principle as will be described later. Also between the other reading lever 3b and retaining hook 5b is disposed a tension spring 7b and the same operation is performed. The numerals 8a and 8b denote positioning stoppers for disengaged positions of the retaining hooks 5a and 5b.

On the other hand, an intermediate portion of a balk 12 having movable hooks 11a and 11b at both ends thereof is pivotably supported at 13 by the fore end portion of a balk lever 10 which is pivotably mounted on another fixed shaft 9, the balk 12 being pivotable around the shaft 13. The movable hooks 11a and 11b at both ends of the balk 12 are supported pivotably relative to shafts 14a and 14b and are engageable and disengageable with respect to the retaining hooks 5a and 5b.

Pushing bars 17a and 17b adapted to pivot in the directions of arrows 15 and 16 through a shaft (not shown) of the dobby machine which is driven interlockedly with a weaving machine. Pushing bars 17a and 18b extend in the direction orthogonal to the paper surface, that is, they extend beyond the balk 12. These bars alternately push the movable hooks 11a and 11b, thereby allowing the balk 12 to pivot about the shaft 13 or allowing the balk lever 10 to turn about the shaft 9 when one movable hook is engaged with a retaining hook. More specifically, in the case where the retaining hook 5a opposed to the movable hook 11a is already in this position of engagement when the balk 12 is turned in a clockwise direction around the shaft 13 while the pushing bar 17a pushes the upper movable hook 11a in the direction of the arrow 15, a cam surface 18a of the movable hook 11a pushes the retaining hook 5a and forces the latter to turn slightly around the shaft 6a. Upon reaching the position of engagement, i.e., the position shown in FIG. 2, the retaining hook 5a is brought into engagement with the movable hook 11a by the spring force.

Subsequently in the state of FIG. 2, the pushing lever 17b moves in the direction of arrow 16' while pushing the lower movable hook 11b, whereby the balk lever 10 which supports the balk 12 is turned in a clockwise direction around the fixed shaft 9 because the balk 12 is now fixed at one end thereof by the retaining hook 5a.

Consequently, a jack lever 21 connected to the balk lever 10 through a connecting rod 19 and an adjuster 20 turns clockwise about a fixed shaft 22, and a heald frame (not shown) suspended from a wire rope connected to the jack lever 21 ascends or descends through the wire rope to control a shedding motion of warp.

Principal portions of the above reading device will now be explained with reference to FIGS. 1 and 3. Although FIG. 1 shows only one retaining hook 5a and reading lever 3a out of the paired retaining hooks 5a, 5b and reading levers 3a, 3b, the other retaining hook 5b and reading lever 3b are also of the same structure and disposed symmetrically with respect to a middle point of line joining the centers of the shafts 6a and 6b.

Figure 1:
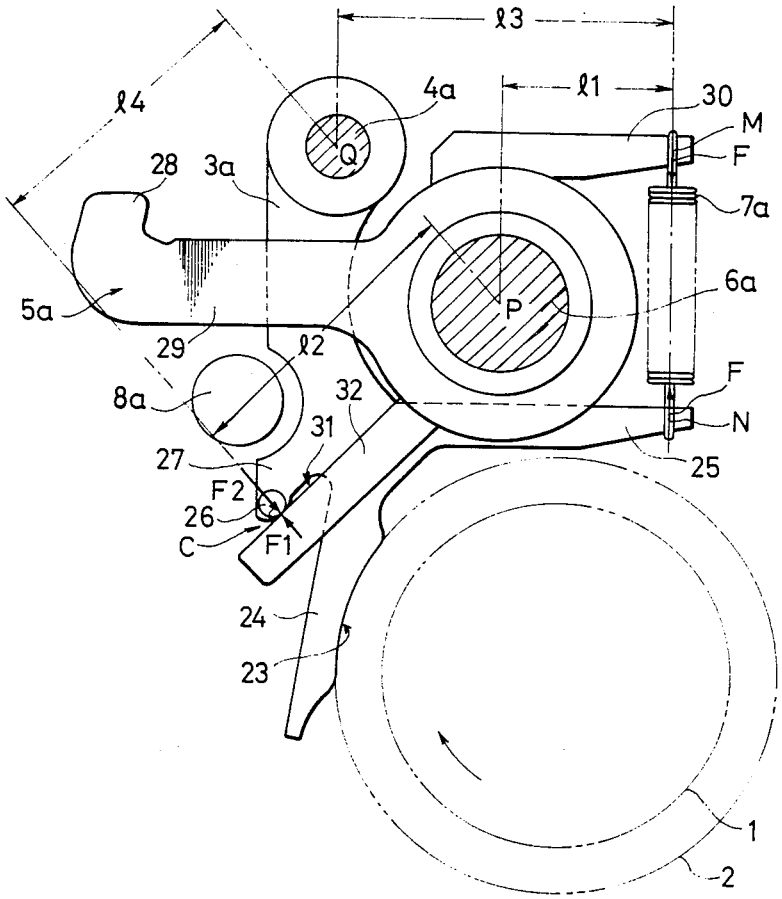
FIG. 1 is a front view illustrating an embodiment of the present invention.
Figure 3:
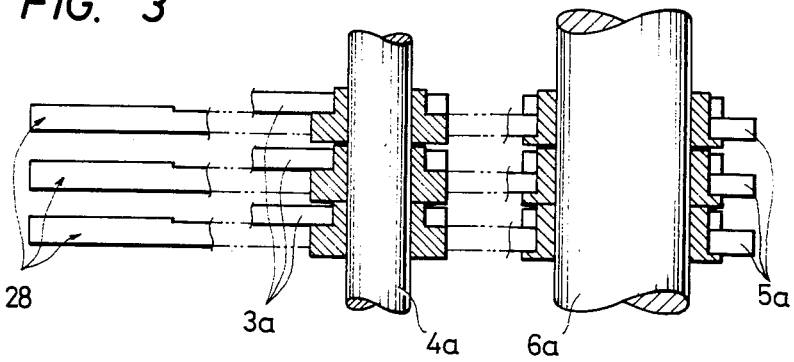
FIG. 3 is a plan view of a portion of FIG. 1.

In FIGS. 1 and 3, the reading lever 3a, which is pivotably mounted on the first fixed shaft 4a, comprises a first arm 24 having a cam surface 23 adapted to abut the peg on the cylinder. A second arm 25 is connected to the retaining hook 5a through the spring 7a, and a third arm 27 has a slider 26 in abutment with the slide surface of the retaining hook 5a. The first, second the third arms 24, 25 and 27 are integrally formed of a rigid material.

The retaining hook 5a, which is pivotably mounted on the second fixed shaft 6a parallel with the first fixed shaft 4a, comprises a first arm 29 having a hook portion 28 adapted to engage the movable hook. A second arm 30 is connected through the spring 7a to the second arm 25 of the reading lever 3a, and a third arm 32 has a slide surface 31 in abutment with the slider 26 of the reeding lever 3a. The first, second and third arms 29, 30 and 32 are integrally formed of a rigid material.

The second arms 25 and 30 respectively of the reading lever 3a and the retaining hook 5a are in an opposed relation to each other with respect to the second fixed shaft 6a. An urging force acting in a counterclockwise direction about the shaft 4a is imparted to the reading lever 3a, while an urging force acting in a clockwise direction about the shaft 6a is imparted to the retaining hook 5a, thereby causing a compressive force to be exerted on a contact portion C between the slider 26 and the slide surface 31.

The tensile force of the spring 7a is assumed to be F, and the distance between the axis P of the retaining hook 5a and a work point M of the spring 7a on the second arm 30 is l1. The distance between the axis P and the contact point C is l2. The distance between the axis Q of the reeding lever 3a and a work point N of the spring 7a on the second arm 25 is l3. Additionally, the distance between the axis Q and the contact point C is 14. The distances l1 to l4 are set to satisfy the following relationship in terms of length: $l1<l2$, $l3>l4$.

The compressive force at the contact point C will now be explained. Assuming that the moment induced by the tensile force F of the spring 7a is sufficiently larger than that induced by the own weight of the reading lever 3a and retaining hook 5a, a pushing force F1 of the retaining hook 5a against the reeding lever 3a is $$F1=(l1/l2)\cdot F \quad \text{(a)}$$

and a pushing force F2 of the reading lever 3a against the retaining hook 5a is $$F2=(l3/l4)\cdot F \quad \text{(b)}$$

Thus, from (a) and (b)

$$F2=(l2/l1)\cdot(l3/l4)\cdot F1 \quad \text{(c)}$$

Where, from $l2>l1$ and $l3>l4$, $$(l2/l1)\cdot(l3/l4)>1 \quad \text{(d)}$$

therefore $$F2>F1$$

Thus, the pushing force of the reading lever 3a against the retaining hook 5a becomes larger, so that the reading lever 3a and the retaining hook 5a undergo an urging force in a counterclockwise direction about the shafts 4a and 6a. When the cam surface 23 of the reading lever 3a is not engaged with the peg of the cylinder 1, the retaining hook 5a is brought into the position restricted by the stopper 8a, namely, its disengaged position from the movable hook. The spring 7a has the function of connecting the reading lever 3a and the retaining hook 5a integrally with each other and the function of urging the cam surface 23 of the reading lever 3a against the peg 2.

In FIG. 1, the alternate long and two short dashes line 2 represents the locus of the fore end of the peg 2 on the cylinder and the like line 1 represents the outer peripheral surface of the cylinder. When the cam surface 23 of the reading lever 3*a* is engaged with the peg 2 it is displaced, and thereby the hook portion 28 of the retaining hook 5*a* is brought into the position of engagement with the movable hook.

Instead of the pin provided on the third arm 27 as the slider 26 of the reading lever 3*a*, there may be used a roller, or a part of the arm 27 may be enlarged in wall thickness, or an end portion of the third arm 27 may be subjected to bending and quench hardening. (For simplicity, hereinafter each of these embodiments is referred to as a "slider." In the case where a roller is used, the "slide" surface 31 should, of course, be considered a rolling surface.)

The reading device having the above-described construction operates in the following manner.

Figure 4:
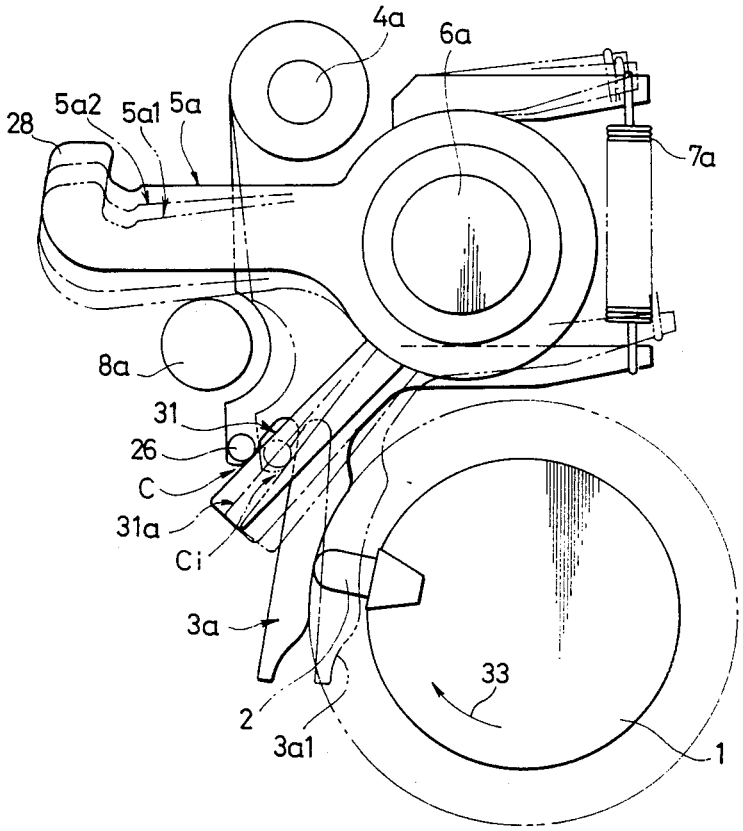
FIG. 4 is an explanatory view showing displacements of the retaining hook and a reading lever.

In FIG. 4, when the peg 2 reaches the cam surface 23 of the reading lever 3*a* with rotation of the cylinder 1 in the direction of arrow 33, the reading lever 3*a* pivots from an alternate long and two short dashes line position 3*a*1 to a solid line position 3*a* about the first fixed shaft 4*a*. At this time, since the slide surface 31 of the retaining hook 5*a* is urged against the slider 26 of the reading lever 3*a* by the spring 7*a*, the retaining hook 5*a* follows the reading lever 3*a* and pivots from an alternate long the two short dashes line position 5*a*1 to a solid line position 5*a* about the second fixed shaft 6*a*, so that the hook portion 28 reaches the position of engagement with the movable hook.

With the pivotal motion of the reading lever 3*a* and the retaining hook 5*a*, a contact point Ci between the slider 26 and the slide surface 31 changes in its distance in a radial direction from the center of the second shaft 6*a*. However its distance from the center of the first fixed shaft 4*a* is constant. In other words, during the pivotal motion of the retaining hook 5*a* from the disengaged position 5*a*1 to the engaged position, the distance from the center of the second shaft 6*a* to the contact point Ci gradually increases. Conversely, while the retaining hook 5*a* pivots from the engaged to disengaged position, the distance between the contact point Ci and the center of the second fixed shaft 6*a* gradually decreases. This has a special meaning for the speed-up of the dobby machine as will be explained later.

When the retaining hook 5*a* reaches its solid line position, i.e., the position of engagement with the movable hook, and engages the movable hook 11*a* which is pushed by the periodically reciprocating pushing bar 17*a* shown in FIG. 2, the cam surface 18*a* of the movable hook 11*a* moves up to the position of engagement and pushes down the retaining hook 5*a* to an alternate long and short dash line position 5*a*2 in FIG. 4. The retaining hook 5*a* is again returned to its solid line position by the force of the spring 7*a*, whereby the engagement with the movable hook is attained. Of course, the motion of the retaining hook 5*a* being pushed down by the movable hook 11*a* means the motion of the lower retaining hook 5*b* in FIG. 2 being pushed up. During this motion, the reading lever 3*a* is held in place by the peg 2, so the slide surface 31 of the retaining hook 5*a* shifts to an alternate long and short dash line position 31*a* as shown in FIG. 4, that is, it temporarily leaves the slider 26 of the reading lever 3*a*, thereby permitting relief of the retaining hook 5*a*.

When the retaining hook 5*a* pivots from its disengaged to engaged position, the spring 7*a* will follow the pivotal motion of the retaining hook and so extend if one end of the spring is fixed. But in the above embodiment, both ends of the spring 7*a* move in the same direction, so the extension of the spring is slight. Consequently, the occurrence of vibrations attributable to the expansion and contraction of the spring is disengaged. This is presumed to be one cause of the difficulty of occurrence of irregular vibrations even at a high speed rotation of the dobby machine, namely, at pivotal motions of short cycle of the retaining hook, reading lever, etc.

Figure 5:
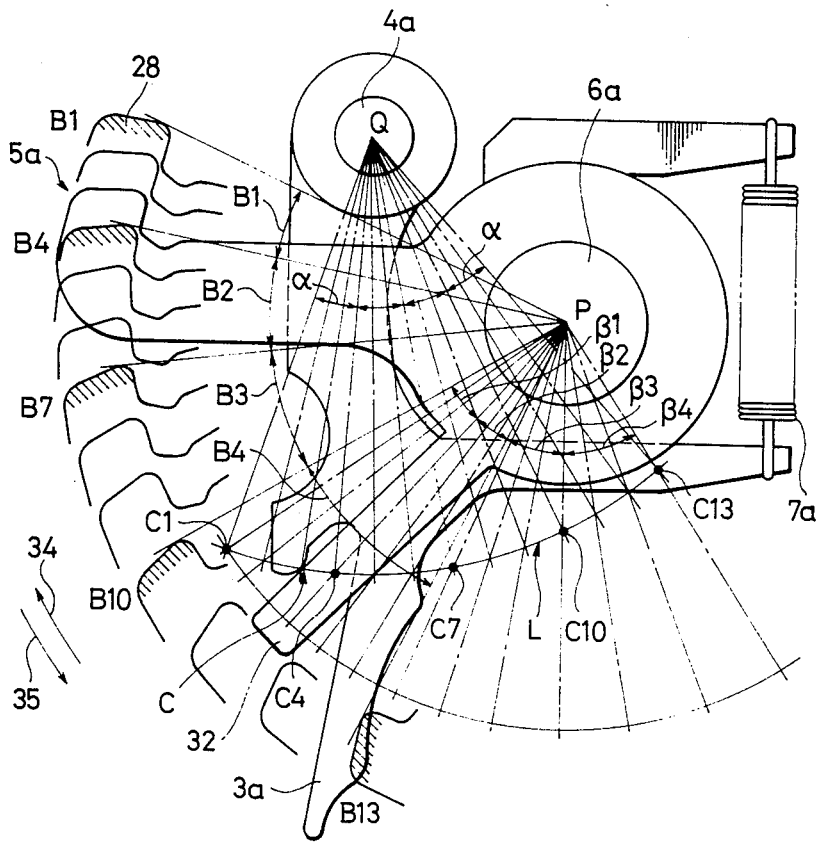
FIG. 5 is an explanatory view showing a non-uniform angular velocity motion of the retaining hook which follows the reading lever.

Characteristics of follow-up pivoting motions attained by supporting the reading lever 3*a* and the retaining hook 5*a* on separate shafts will now be explained with reference to FIG. 5. In FIG. 5 the pivoting amount of the reading lever 3*a* and that of the retaining hook 5*a* exaggerated for convenient explanation, but actually those amounts are as shown in FIG. 4, provided the tendency of motion is the same in both figures.

In FIG. 5, the reading lever 3*a* performs a uniform motion, and an arcuate locus L around the axis Q represents the locus of the contact point C of the slide surface 31. If contact points C1 to C13 are divided by equal angles than the angle, for example, between contact points C1 and C4, between contact points C4 and C7, between contact points C7 and C10 and between contact points C10 and C13 with the axis Q as the center are all $\alpha$. On the other hand, the angle between contact points C1 and C4 with the second axis P as the center is $\beta 1$, and this means that while the reading lever 3*a* turns between contact points C1 and C4, the retaining hook 5*a* turns by an angle of $\beta 1$. Likewise, if the angles between contact points C4 and C7, between C7 and C10 and between C10 and C13 with the axis P as the center are $\beta 2$, $\beta 3$ and $\beta 4$, respectively, there exists the following relationship:

$$\beta 1 < \beta 2 < \beta 3 < \beta 4$$

Since the angles of the contact points C1 to C13 with respect to the axis P are points on the slide surface 31 of the retaining hook 5*a*, the hook portion 28 of the first arm 29 integral with the third arm 32 having the slide surface 31 also pivots in the same manner. While the third arm 32 moves between C1 and C13, the hook portion 28 moves between B1 and B13 at the same angle. More specifically, the positions of the hook portion corresponding to the contact points C1, C4, C7, C10 and C13 are B1, B4, B7, B10 and B13, respectively. That is, while the reading lever 3*a* performs a uniform motion, the retaining hook 5*a* performs a non-uniform motion, and when the retaining hook 5*a* pivots in the direction of arrow 34, the angular velocity decreases gradually, while when it turns in the direction of arrow 35, the angular velocity increases gradually.

Figure 6:
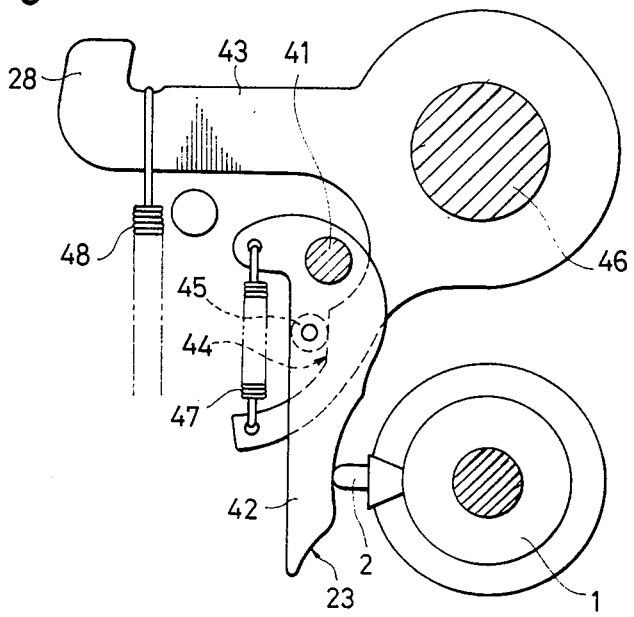
FIG. 6 is a front view illustrating another embodiment of the present invention.

Referring now to FIG. 6, there is illustrated a reading device according to another embodiment of the present invention in which a reading lever 42, pivotably mounted on a first fixed shaft 41, has a cam surface 23 adapted to abut a peg 2 and a slider 45 which is in pressure contact with a slide surface 44 of a retaining hook 43. On the other hand, the retaining hook 43, which is pivotably mounted on a second fixed shaft 46, has a hook portion 28 adapted to engage a movable hook of the same structure as previously described and also has the slide surface 44 which is in contact with the slider 45 of the reading lever 42.

The reading lever 42 and the retaining hook 43 are urged by a spring 47 in a direction in which the slider 45 and the slide surface 44 are kept in pressure contact with each other. The retaining hook 43 performs a pivotal motion with displacement of the reading lever 42. Further, a tension spring 48 is connected between the retaining hook 43 and a retaining hook (not shown) similar thereto provided in a symmetrical position with respect to the cylinder 1.

Figure 7:
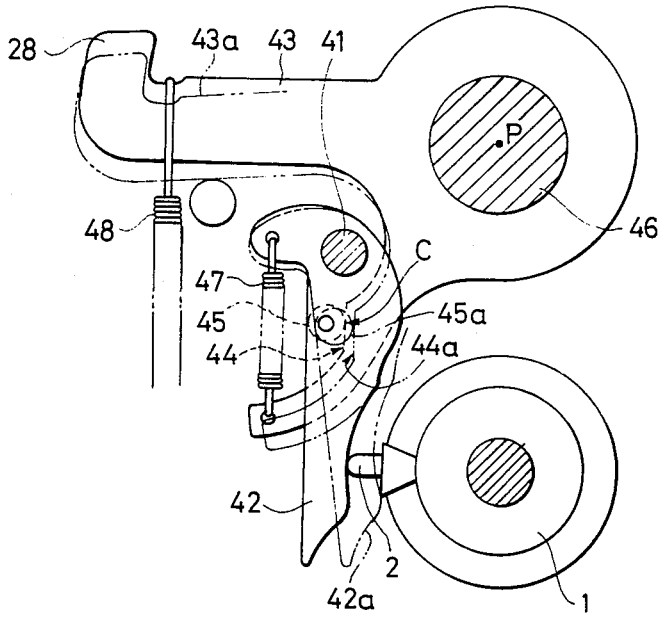
FIG. 7 is a view illustrative of operations thereof.

Since the biasing force of the spring 47 is set larger than that of the spring 48, the reading lever 42 and the retaining hook 43 are urged integrally by the spring 48 in a direction in which the reading lever 42 is brought into pressure contact with the peg 2. Therefore, as the reading lever 42 is disengaged from the peg 2 and pivots from the solid line position 42 to an alternate long and short dash line position 42*a* by virtue of the spring 48, as shown in FIG. 7, the slider 45 on the reading lever 42 moves along the slide surface of the retaining hook 43, that is, in a direction in which the distance between the axis P of the second fixed shaft 46 and the contact point C becomes shorter Meanwhile the retaining hook 43 pivots in a counterclockwise direction and the hook portion 28 moves to a disengaged position.

Alternately, when the retaining hook 43 engages the movable hook in its position of engagement, only the retaining hook 43 pivots counterclockwise at a slight angle about the axis 46 against the spring 47, as in the previous embodiment, and the contact point C opens, thus permitting relief of the hook portion 28.

Also in this embodiment, the reading lever 42 and the retaining hook 43 are supported by the separately provided first and second fixed shafts 41 and 46, respectively. Both the reeding lever 42 and retaining hook 43 perform a pivoting motion while the slider 45 of the reeding lever 42 moves along the slide surface 44 of the retaining hook 43. Therefore, as in the previous embodiment, while the reading lever 42 performs a uniform angular velocity motion, the retaining hook 43 pivots while changing its angular velocity. Thus, it is possible to perform about the same motion as in FIG. 5.

In the present invention, as set forth hereinabove, the retaining hook adapted to take engaged and disengaged positions with respect to the movable hook while following the reading lever which shifts between two positions according to whether a peg is present or not, performs a pivotal motion of non-uniform angular velocity so that the angular velocity decreases gradually when the retaining hook pivots from its disengaged to engaged position, while the angular velocity increases gradually when the retaining hook pivots from its engaged to disengaged position. Consequently, at the time when the retaining hook reaches it position of engagement or when it is disengaged from the movable hook, a sudden motion thereof is cushioned, that is, such shock and vibration created at the time of start and stop of a uniform motion are cushioned, thus permitting speed-up of the dobby machine, for example, permitting operation of a double lift dobby machine at 1,000 r.p.m.

I claim:

1. A reading device in a dobby machine, comprising:

a reading lever adapted to pivot between first and second positions;

a first fixed shaft pivotally supporting the reading lever;

means for intermittently urging the reading lever toward said first position;

a retaining hook adapted to pivot with said reading lever between two positions of engagement and disengagement with respect to a movable hook such that the retaining hook is in the engagement position when the reading lever is in the first position and the retaining hook is in the position of disengagement when the reading lever is in the second position;

a second fixed shaft pivotally supporting the retaining hook, said reading lever having a slider which is in abuttment with a slide surface formed on said retaining hook; and a spring acting in a direction such that said slider comes into pressure contact with said slide surface, said spring being connected between said reading lever and said retaining hook, said first and second fixed shafts being disposed in such a positional relation that as said reading lever pivots on the first shaft, the contact portion of said slider and said slide surface moves along a radial direction of a circle with said second fixed shaft as the center of the circle and said retaining hook performs a non-uniform angular velocity motion.

2. A reading device in a dobby machine of the type having a heald frame and means for actuating the heald frame in response to the reading device, the device comprising:

a first pivotal support member;

a retaining member for engaging the heald frame actuating means, the retaining member being pivotably carried by the first member and pivotable between engaged and disengaged positions with respect to the heald frame actuating means;

a second pivotal support member disposed in proximity to the first pivotal support member and having a different pivotal axis than the first member;

a control lever pivotally carried by the second member and engagable with the retaining member, the control lever being pivotable between a first and a second angular position; and means positioned adjacent to the control lever for displacing the control lever between the first and second angular positions, wherein the control lever and retaining member are positioned relative to each other so that angular movement of the control lever between the first and second positions causes an angular movement of the retaining member between the engaged and disengaged positions, which movement is non-uniform relative to the movement of the control lever.

3. A reading device as in claim 2, further comprising:

an elastic member attached to the retaining member and also to the control lever so that the force exerted by the elastic member urges the retaining member toward the disengaged position.

4. A reading device in a dobby machine of the type having a heald frame, means for actuating the heald frame, and a rotating drum having pegs protruding from the drum surface for controlling the motion of the heald frame in accordance with the placement of the pegs, the device comprising:

a first shaft;

a reading lever having three arms and being rotatably mounted on the first shaft, the first arm having a cam surface abuttable with the pegs protruding from the drum, the second arm forming an elongated member, and the third arm having a slider;

a second shaft disposed in proximity to the first shaft;

a retaining hook having three arms and being rotatably mounted on the second shaft, the first arm having a hook which is rotatable between engaged and disengaged positions with respect to the heald frame actuating means, for engaging the actuating means, the second arm forming an elongated member, and the third arm having a slide surface abuttable with the slider on the third arm of the reading lever; and an elastic member coupling the elongated members of the second arm of the reading lever and the second arm of the retaining hook, so that the slider is forced against the slide surface of the third arm of the retaining hook and so that the hook on the first arm of the retaining hook is urged toward the disengaged position by the force of the elastic member.

5. A reading device as in claim 4, further comprising:

a stopper member disposed so that the stopper member abuts the retaining hook when the retaining hook is in the disengaged position.

6. A reading device as in claim 4, wherein the distance from the axis of rotation of the retaining hook to the coupling point of the elastic member on the second arm of the retaining hook is l1, the distance from the axis of rotation of the retaining hook to the contact point of the slider on the slide surface is l2, the distance from the axis of rotation of the reading lever to the coupling point of the elastic member on the second arm of the reading lever is l3, the distance from the axis of rotation of the reading lever to the contact point of the slider on the slide surface is l4, and l1, l2, l3 and l4 satisfy the following relationship:

l1 is less than l2 and l3 is greater than l4, so that the elastic member coupling the reading lever and the retaining hook urges the retaining hook toward the disengaged position.

7. A reading device in a dobby machine of the type having a heald frame, means for actuating the heald frame, and a rotating drum having pegs protruding from the drum surface for controlling the motion of the heald frame in accordance with the placement of the pegs, the device comprising:

a first shaft;

a reading lever having two arms and being rotatably mounted on the first fixed shaft, the first arm of the reading lever having a cam surface abuttable with the pegs protruding from the drum, the second arm of the reading lever forming an elongated member;

a slider associated with the first arm of the reading lever;

a second shaft disposed in proximity to the first shaft;

a retaining hook rotatably mounted on the second shaft and having two arms, the second arm of the retaining hook forming a hook which is rotatable between engaged and disengaged positions with respect to the heald frame actuating means, for engaging the actuating means, the first arm of the retaining hook having a slide surface abuttable with the slider, said slide surface being shaped so that, as the second arm of the retaining hook rotates toward the engaged position, the slider moves, along the slide surface, away from the second shaft such that the second arm of the retaining hook decelerates as it rotates toward the engaged position while the reading lever rotates at a uniform speed;

a first spring coupling the second arm of the reading lever and the first arm of the retaining hook, so that the slider and the slide surface are kept in pressure contact; and a second spring urging the hook of the second arm of the retaining hook toward the disengaged position, wherein the second spring exerts a smaller rotational force on the retaining hook than the first spring.

8. A reading device as in claim 7, further comprising:

a stopper member disposed so that the stopper member abuts the retaining hook when the hook is in the disengaged position.

9. A reading device for dobbys of the type which is controlled by the placement of pegs on a control mechanism, the reading device comprising:

a pivotable reading lever having a cam surface adapted to abut the pegs on the control mechanism so that contact with the pegs pivots the reading lever;

a pivotable retaining hook, having a different pivotal axis than the reading lever, and adapted to pivot with said reading lever between two positions of engagement and disengagement with respect to a moveable hook, said retaining hook having a slide surface;

a slider on the reading lever and abuttable with the slide surface; and an elastic member connected between said reading lever and said retaining hook and acting in a direction such that said slider comes into pressure contact with said slide surface, the slider and the slide surface being formed so that the force of the elastic member tends to simultaneously rotate both the reading lever and retaining hook while the slider slides along the slide surface.

10. A reading device as claimed in claim 9, further comprising a first fixed shaft pivotally supporting the reading lever and a second fixed shaft pivotally supporting the retaining hook, wherein said first and second fixed shafts are disposed in such a positional relation that as said reading lever turns, the contact portion between said slider and said slide surface moves along a radial direction of a circle with said second fixed shaft as the center of the circle, and said retaining hook performs a non-uniform angular velocity motion relative to the angular velocity of the reading lever.

11. A reading device as claimed in claim 10, wherein said reading lever comprises a first arm having a cam surface adapted to abut the pegs of the control mechanism, a second arm connected to the retaining hook through the elastic member, and a third arm having said slider, said first, second and third arms of the reading lever being integrally formed of a rigid material.

12. A reading device as in claim 10, wherein said retaining hook comprises a first arm having a hook portion adapted to engage the movable hook, a second arm connected through the elastic member to the second arm of the reading lever, and a third arm having said slide surface, said first, second and third arms of the retaining hook being integrally formed of a rigid material.

13. A reading device as in claim 12, wherein said second arms respectively of the reading lever and the retaining hook are in an opposed relation to each other with respect to the second fixed shaft, and the force of the elastic member acting in a first rotational direction about the first shaft is imparted to the reading lever, while the force of the elastic member acting in a second rotational direction about the second shaft is imparted to the retaining hook, so that a compressive force is exerted on a contact point between the slider and the slide surface, and wherein the first rotational direction is opposite to the second rotational direction.

14. A reading device as claimed in claim 13, wherein distances l1, l2, l3 and l4 are set to satisfy the following relationship in terms of length:

$$l1 < l2,\ l3 > l4,$$

if the distance between the axis of the second shaft and the work point of the second arm of the retaining hook with the elastic member is assumed to be l1, the distance between the axis of the second shaft and the contact point of the slide surface with the slider is assumed to be l2, the distance between the axis of the first shaft and the work point of the second arm of the reading lever with the elastic member is assumed to be l3, and the distance between the axis of the first shaft and the contact point of the slider with the slide surface is assumed to be l4.

15. A reading device for a dobby machine of the type having means for actuating a heald frame, the device comprising:

a retaining hook, said retaining hook being movable between disengaged and engaged positions with respect to the heald frame actuating means; and decelerating means for decelerating the retaining hook as the hook moves toward the engaged position.

16. A reading device as in claim 15, wherein the movement of the retaining hook between the disengaged and engaged positions is a rotational movement and the decelerating means decelerates this rotational movement.

17. A reading device in a dobby machine of the type having a heald frame, actuating means for actuating the heald frame, and control means for controlling the actuation of the heald frame, the reading device comprising:

a rotatable reading lever having three arms, the first arm of the reading lever being engagable with the control means;

a rotatable retaining hook, the axis of rotation of the retaining hook being spaced from the axis of rotation of the reading lever, wherein the retaining hook has three arms, the first arm of the retaining hook forming a hook rotatable between engaged and disengaged positions with respect to the heald frame actuating means, and wherein the third arm of the reading lever is engagable with the third arm of the retaining hook; and an elastic member connected between the second arm of the reading lever and the second arm of the retaining hook, so that the force of the elastic member forces the third arm of the reading lever against the third arm of the retaining hook and simultaneously urges the retaining hook and reading lever in the same rotational direction.

* * * * *